United States Patent [19]

Fields et al.

[11] 4,104,129

[45] Aug. 1, 1978

[54] LOW TEMPERATURE CARBONIZATION AND DESULFURIZATION OF COAL UNDER ELEVATED PRESSURES

[75] Inventors: Marvin C. Fields, Wilkins Township, Allegheny County; Richard F. Wyse, Plum Borough, both of Pa.

[73] Assignee: United States Steel Corporation, Pittsburgh, Pa.

[21] Appl. No.: 501,898

[22] Filed: Aug. 30, 1974

Related U.S. Application Data

[63] Continuation of Ser. No. 410,072, Oct. 26, 1973, abandoned, which is a continuation of Ser. No. 195,075, Nov. 2, 1971, abandoned.

[51] Int. Cl.[2] ..... C10B 55/10; C10B 57/00

[52] U.S. Cl. ..... 201/17; 201/22; 201/28; 201/31; 201/35; 201/30; 208/8; C10G/1/00

[58] Field of Search ..... 201/17, 31, 35, 22; 44/1 R; 208/8; 423/449, 461; 62/9, 11

[56] References Cited

U.S. PATENT DOCUMENTS

| | | | |
|---|---|---|---|
| 2,595,366 | 5/1952 | Odell et al. | 201/17 |
| 2,726,148 | 12/1955 | McKinley et al. | 201/17 X |
| 3,364,685 | 1/1968 | Perret | 62/9 |
| 3,401,089 | 9/1968 | Friedrich et al. | 201/6 |
| 3,472,624 | 10/1969 | Ridley | 201/17 X |
| 3,640,016 | 2/1972 | Lee | 201/17 X |
| 3,747,360 | 7/1973 | Perrett | 62/9 |

*Primary Examiner*—Joseph Scovronek
*Attorney, Agent, or Firm*—W. Gary Goodson

[57] ABSTRACT

This invention concerns a carbonization and desulfurization process in which elevated pressures are used so that the product gases contain sufficient hydrogen for use as a recycle stream in the carbonization and desulfurization. The elevated pressures permit product recovery systems for the gas products which utilize the elevated pressures of the carbonization and desulfurization.

6 Claims, 2 Drawing Figures

Figure 1A:
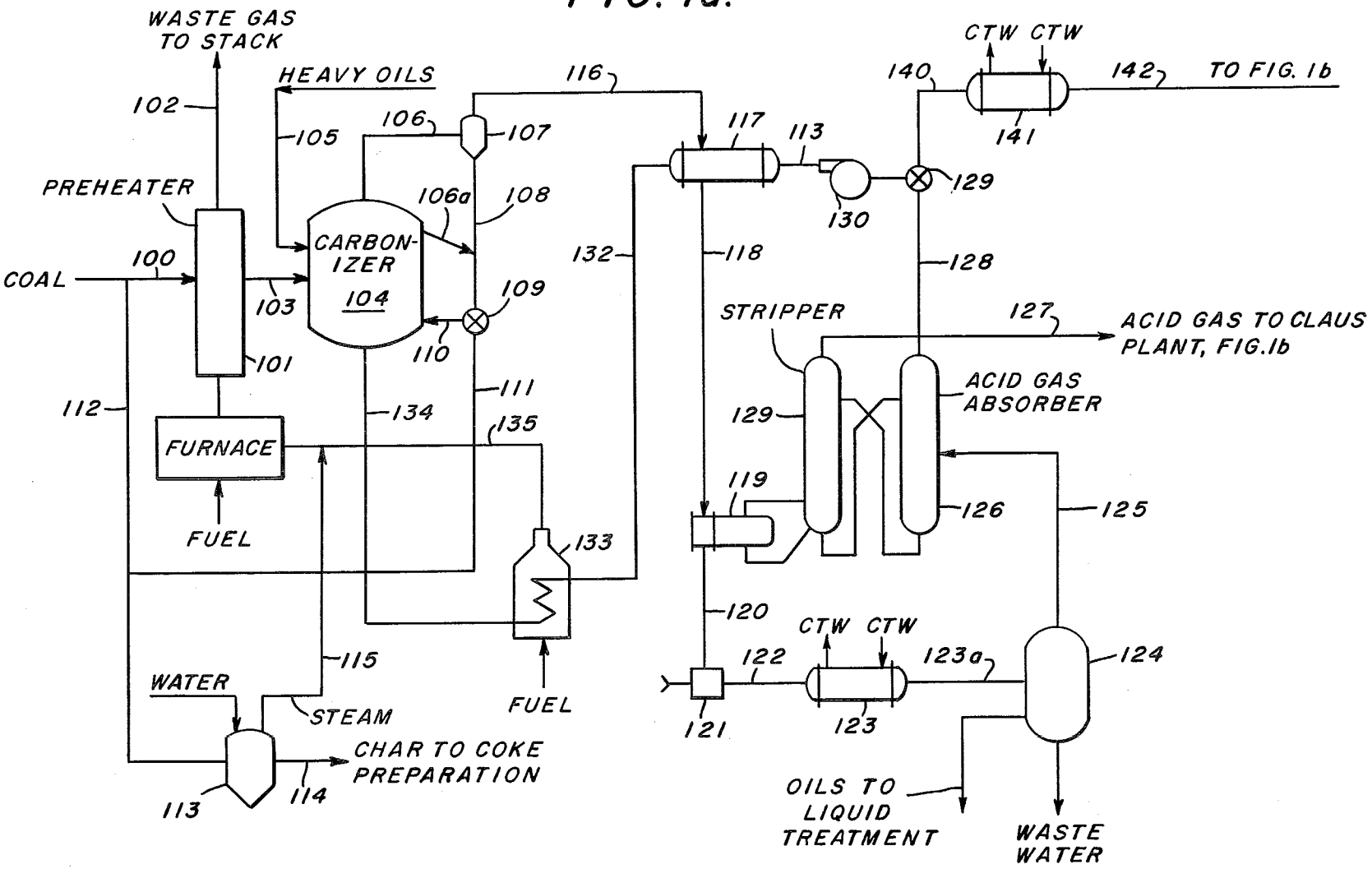

LOW TEMPERATURE CARBONIZATION AND DESULFURIZATION OF COAL UNDER ELEVATED PRESSURES

This is a continuation of application Ser. No. 410,072, filed Oct. 26, 1973, now abandoned; which is in turn a continuation of Ser. No. 195,075, filed Nov. 2, 1971, now abandoned.

BACKGROUND OF THE INVENTION

Coal may be converted by heating into a solid carbonaceous residue known as char, gas containing significant amounts of hydrogen and liquids having large proportions of aromatics and heterocyclics. This is generally described as coal carbonization. When high sulfur coal is carbonized, it is especially important that a low sulfur char be obtained which is suitable for use as a solid fuel material in metallurgical ore reduction processes or as a solid fuel for general heating purposes. Even if the char is not destined for the production of metallurgical coke, but is to be burnt as a fuel, present emphasis on low sulfur fuels to reduce sulfur oxide air pollution, also favors the production of low sulfur char. The large volumes of product gas require economic and effective means for conversion into more valuable individual components. By the practice of the invention, these and other related difficulties are overcome.

OBJECTS OF THE INVENTION

Among the purposes of this invention is to provide a carbonization and desulfurization process for coal in which a mixture of coal and char are contacted with a hydrogen containing gas at elevated pressures. Further, these processes include a process in which a portion of the product gases may be desulfurized and recycled to provide the hydrogen containing gas.

In addition, such a process is provided in which the contacting may be carried out under fluidized bed conditions. There is also provided a method for recovery of the product gases in which the pressures of the carbonization and desulfurization process are utilized to recover individual components of the gases. Moreover, the processes are intended to provide a low sulfur char which is suitable in itself as a solid fuel or which may be processed into a solid fuel product for metallurgical ore reductions.

DESCRIPTION OF THE INVENTION AND FIGURES

In the practice of the invention, a mixture of finely divided coal and char are contacted with a hydrogen containing gas at elevated pressures and temperatures which result in a carbonization and desulfurization to yield a char preferably containing less than 1 percent by weight of sulfur.

The FIGURE is a block flow diagram illustrating one embodiment of the invention.

The carbonization and desulfurization with which this invention is concerned is known in the art as low temperature carbonization as distinguished from the high temperature coke oven process. Carbonization of the coal produces char, the solid carbonaceous residue, and gases which also contain volatilized normal liquids. The desulfurization which occurs converts the sulfur present in the coal to hydrogen sulfide gas so that a low sulfur char is obtained.

The gas with which the mixture of char and coal is contacted contains hydrogen. It has been found that the carbonization and desulfurization of high ash and high sulfur coal proceeds readily in such an atmosphere. The gas will have at least 20 mol percent of hydrogen and may have as much as 100 mol percent. Hydrogen sulfide concentrations must be controlled to below about 2 mol percent of the gas. It is known that increased concentrations of hydrogen sulfide will inhibit the desulfurization of the coal and the production of low sulfur char — see Gorin et al, U.S. Pat. Nos. 2,717,868 and 2,824,047.

As an example of controlling hydrogen sulfide concentration, when co-current contacting of gas and solids is employed, it is preferred that the initial concentration of $H_2S$ be kept below about 0.02 mol percent, particularly below about 0.01 mol percent. The exit concentration of hydrogen sulfide may be about 0.3 mol percent of $H_2S$ for an average $H_2S$ concentration in the carbonization and desulfurization of 0.15 mol percent; as the average concentration of $H_2S$ increases above this value, desulfurization is progressively inhibited. If a portion of the product gases are recycled to furnish the hydrogen rich gas for the carbonization and desulfurization, its hydrogen sulfide content must be controlled. This may be done by conventional techniques for sulfur removal such as aqueous washing or contact with basic solids such as heavy metal oxides. Aqueous washing is particularly suitable because the presence of moisture in the hydrogen rich gas has a beneficial effect on the rate of carbonization and desulfurization. This hydrogen rich gas must be substantially free of oxygen or air to prevent oxidation in the char/coal mixture.

The carbonization and desulfurization is conducted at elevated pressures. These pressures range from 30 to 300 psi, preferably from 50 to about 100 psi. By the use of such pressures, the partial pressure of $H_2$ is increased so that product gases can be recycled to the reactor without the addition of extrinsic hydrogen. At these pressures and with the presence of hydrogen, the carbonization and desulfurization of the mixture of coal and char can yield a char with sulfur contents below about 1%. The elevated pressures of the carbonization and desulfurization facilitate the recovery of individual components from the product gases by eliminating the need for additional compression of the gases in subsequent recovery steps.

The elevated temperatures at which the carbonization and desulfurization is performed are in the range of about 950° to about 1500° F. Temperatures of from about 1150° to 1470° F are especially preferred because of the increased rates of desulfurization which are achieved. Reference is hereby made to the extensive discussion of temperature effects on carbonization and desulfurization in the copending application U.S. Ser. No. 205,248 of Masciantonio and Schowalter entitled "Coal-Conversion Process", filed Dec. 6, 1971, now abandoned which disclosure is hereby incorporated by reference.

This invention is particularly concerned with high ash and high sulfur coals. These coals are generally unsuitable for use in metallurgical ore reduction processes. By this invention, there is obtained from this coal a low sulfur char which can itself be used as a solid fuel or can be made into a solid fuel material suitable for metallurgical ore reduction. High sulfur coals are generally those containing more than about 1.1 percent by weight of sulfur on a moisture ash free (MAF) basis. These coals when coked in an oven process do not give coke with a sulfur content acceptable for metallurgical purposes, i.e. less than 1 percent by weight of sulfur.

Moreover, the low sulfur char produced by this invention can be combined with hydrocarbon binders and processed into a solid fuel material which has the strength and abrasion resistance which is suitable for blast furnace conditions. Therefore, both coking and non-coking coals may be used in the practice of the invention. The char produced by this invention will have a sulfur content less than 1 percent by weight. Preferably, the sulfur content will be less than 0.75 percent, the range of about 0.4 to 0.6 percent is desirable.

In the process of the invention, a mixture of coal and char is subjected to the hydrogen rich gas at elevated temperatures and pressures. When operating under fluidized bed conditions, the presence of the char gives good fluidization characteristics to the whole bed of char and coal. The ratio of char to coal may be at least about 0.5 to 1. In many cases, a ratio of 1 to 1 gives very good results. The desired ratio of char and coal may be obtained by externally mixing the char and coal prior to carbonization and desulfurization. When operated under fluidized bed conditions, the inherent mixing of the fluid bed also permits mixing in the desired ratio by accumulating char as inventory or recycle of product char to the fluidized bed. Recycle of product char may be by external recycle lines or by internally recycling between stages in a multi-stage operation.

The residence time for the mixture of coal and char depends upon the rate of desulfurization. At temperatures of about 1150° F and a pressure of 95 psia with about 30 mol percent of hydrogen, 155 minutes is sufficient. As noted previously, higher temperatures, and higher hydrogen concentrations increase the rate of desulfurization. Carbonization, being the conversion of the coal into a carbonaceous residue and gases and liquids, is completed before the desired desulfurization of the carbonaceous residue has occurred. For example, under these conditions, the carbonization may be complete in about 30 minutes. Consequently, residence time depends upon the selected operating conditions and product characteristics.

Product gases from the carbonization and desulfurization contain hydrogen, carbon monoxide, carbon dioxide, hydrogen sulfide, ammonia and water besides the organic compounds such as methane through butane, ethylene through butylene, heavy tar acids, light oil saturates, benzene, toluene and zylenes. These components may be recovered individually from the product gases. The hydrogen concentration is high enough so that a portion of the product gases can be recycled to the carbonization and desulfurization stage. The recovery system will include conventional processing steps such as washing, low temperature condensation, distillation, etc. By conducting the carbonization and desulfurization at elevated pressures, these recovery steps may be performed without additional compression of the gases so that valuable equipment savings result.

The Figure, 1*a* and 1*b*, illustrates an embodiment of the invention in which carbonization and desulfurization is followed by a gas recovery system. A high ash coking coal having 8.5% moisture and 5.2% ash is screened to a size range of ⅛ by 100 mesh. By line 100 the coal is conveyed to a coal preheater 101 where it is heated to about 400° F. Temperatures substantially in excess of 400° F have been found to drive off acidic gases and noxious liquids from the coal. While these preheaters may be of any conventional design, fluidized beds are preferred. In the preheater, hot flue gas from the carbonizer fluidizing gas burners 133 are heated in a furnace 136 and used as fluidizing gases in the preheater. The preheater operates at atmospheric pressure. The fluidizing gases and moisture from the coal leave the preheater via line 102 where they are discharged to a stack.

Dried coal from the preheater is at 400° F and is sent by line 103 to the carbonizer and desulfurizer 104. This coal is injected into the carbonizer at a pressure of about 95 psi. The carbonizer and desulfurizer 104 is designed for contacting the mixture of coal and char in the carbonizer with the hydrogen containing gas. It may be a vertical kiln or preferably a fluidized bed unit. A desired form of fluidized bed unit would have two or more fluidization compartments arranged on top of each other. Coal would be fed into the top compartment while char may be recycled between compartments by stand legs or by exterior piping. The fluidizing gases would enter the top-most compartment and then be recycled to the bottom of each lower compartment with a final take-off at the top of the bottom-most compartment. This multiple bed arrangement reduces the overall equipment size.

The carbonizer and desulfurizer may be operated at 1150° F and 95 psia with a residence time of 155 minutes for the coal. Heavy hydrocarbon oils, BP above 750° F, may be injected into the carbonizer and desulfurizer via line 105 where they are cracked into coke and volatiles.

Volatile gases containing entrained char leave the carbonizer via line 106 to separator 107 where this char is separated. The major amount of char product flows by line 106*a* to line 108 where it mixes with the recovered char. Means may be provided at 109 to recycle a portion of the char to the carbonizer via line 110. The remainder of the char passes by line 111. Means may also be provided to recycle a portion of char by line 112 to the screened coal for admixture prior to carbonization, e.g. at the preheater 101. The remaining char flows into a quench station 113 where water is used to cool the char to about 325° F. The steam generated by the quench is sent by line 115 to be mixed with the carbonizer heating furnace flue gases. Cooled char is sent by line 114 to a metallurgical coke facility. This facility forms the char into a metallurgical coke product by briquetting, pelletization or nodulizing the char with a hydrocarbon binder such as heavy oil, followed by carbonization. A preferred facility will utilize the char obtained by this process for the processes and products described in copending application U.S. Ser. No. 191,651 of Schapiro and Shoenberger entitled, "Method and Product for a Metallurgical Coke Substitute," filed Oct. 22, 1971, now abandoned which disclosure is hereby incorporated for reference.

The volatiles separated from the char are transported by line 116 to heat exchanger 117. In the heat exchanger, the volatiles are cooled from 1150° to 525° F by heating the hydrogen containing gas for the carbonizer and desulfurizer. The cooled gases go by line 118 to a boiler 119 and again are cooled to 363° F and generate steam for use in the process, here shown used in a stripping and absorbing operation. After leaving the boiler by line 120, the gases are sent to a nitric oxide removal unit 121; here nitric oxides in the gases may be removed by the injection of ozone into the gas stream. In line 122, the gases are carried to a heat exchanger 123 to be cooled to 200° F. At this temperature, heavy hydrocarbons and water condense from the gases and are removed by decantation at 124. From the decanter, the gases are conveyed by line 125 to a hydrogen sulfide removal section shown as an acid gas absorber 126 and a stripper 129. Here, 94% of the hydrogen sulfide and 50% of the carbon dioxide is removed from the gas by contact with aqueous potassium carbonate solutions. The cleaned gases will have about 0.02 mol percent hydrogen sulfide and 1.3 mol percent carbon dioxide. The hydrogen sulfide and carbon dioxide removed from the gases are stripped and sent by line 127 to a Claus plant 150 for recovery of sulfur and carbon dioxide.

By line 128, the cleaned gases are sent to a valve means 129. The hydrogen content of the gas is high enough because of the elevated operating pressure of the carbonizer desulfurizer, e.g. 95 psia, so that a portion may be recycled to the carbonizer and desulfurizer as the hydrogen containing gas therein. This portion is recycled first by passing through compressor 130 to reach a pressure of 120 psia and then goes by line 113 to heat exchanger 117 and then by line 132 to furnace 133 where it is heated to about 1400° F for introduction into the carbonizer by line 134.

Furnace 133 uses fuel gas and air of a ratio so controlled that there is no excess oxygen in the flue gases. These gases by line 135 go to furnace 136 where they are heated by direct combustion to about 1000° F for use in the coal preheater 101.

Figure 1B:
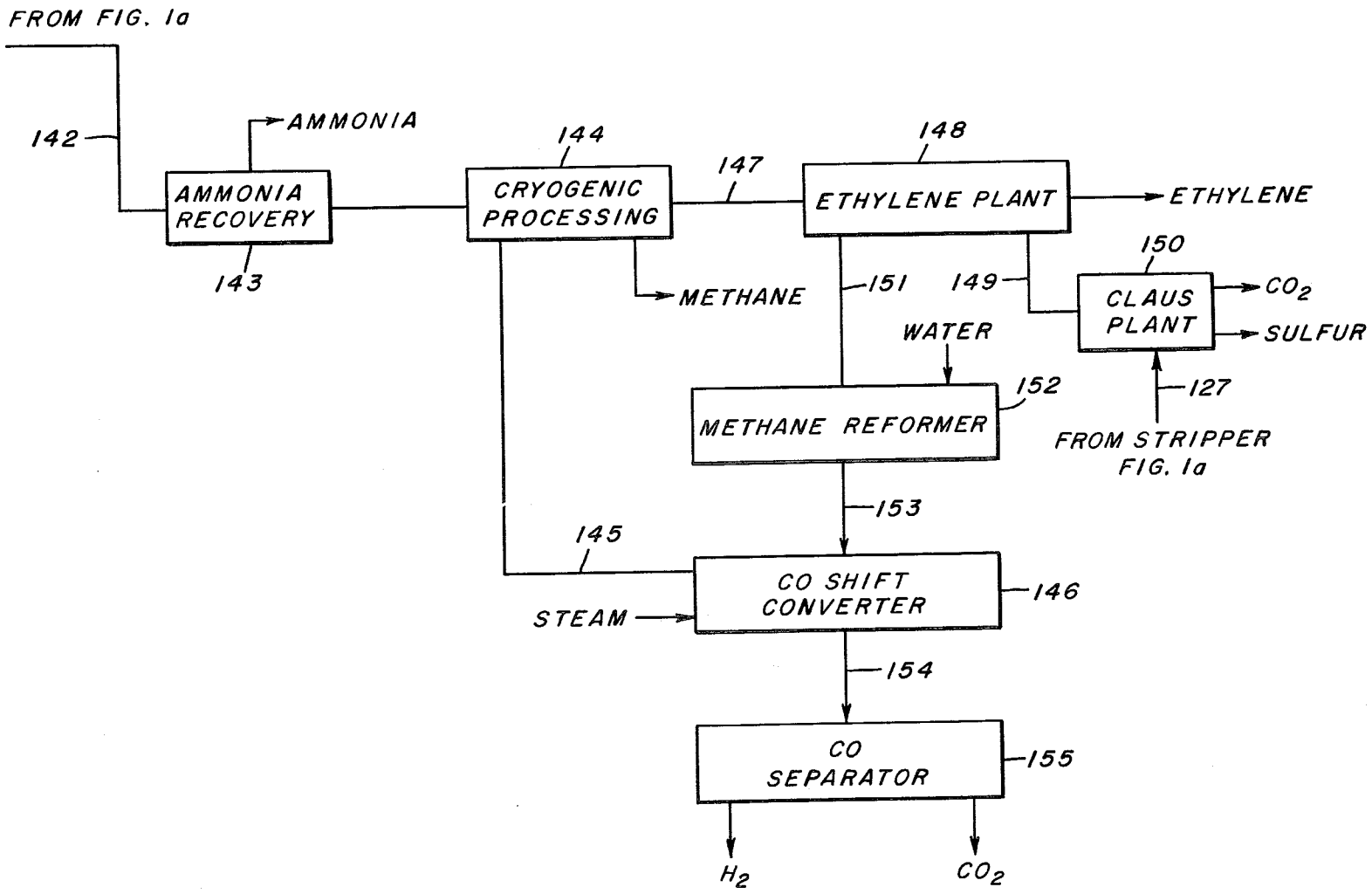

The remaining cleaned gases go by line 140 to a heat exchanger 141 where they are cooled to 100° F. At this point, the gases may be processed by the low temperature condensation gas recovery system illustrated in FIG. 1*b*. This recovery system may be of a size to process feed streams which include gas products from other coal conversion operations such as coal liquefaction, coke carbonization, coke preparation, etc. Where these other gas products contain components of the same kind but in higher concentration than the gases from the carbonization and desulfurization, the combined feed stream will allow the recovery system to operate at its maximum efficiency. For example, while the carbonization and desulfurization may yield a gas having about 0.1 mol percent $NH_3$, a combined feed stream including gases from coal liquefaction may have as much as 3 mol percent $NH_3$. The ammonia recovery will be substantially greater from the combined feed.

The gas stream is sent by line 142 to an ammonia recovery section where ammonia is removed by absorption in aqueous phosphate solution.

The gas stream may then be sent to a low temperature condensation system 144 where by using cryogenic conditions, light oil, methane, ethylene and acid gases are condensed. Especially in this unit, the high pressures used in the carbonization and desulfurization allow favorable equilibriums in the liquid-vapor condensation without the need for additional compression of the gases. In the cryogenic condensation, light oil, ethane, ethylene and acid gases are condensed as a fraction; methane is condensed as another fraction. A residual gas stream is obtained which contains hydrogen, methane and carbon monoxide. There may be as much as about 80 mol percent $H_2$ with 10 mol percent of methane and 10 mol percent of carbon monoxide.

This residual gas stream is sent by line 145 to a carbon monoxide shift converter 146. There it is heated, compressed to 300 psia and reacted with steam to give a mixture of carbon dioxide, residual methane, and hydrogen gas. This mixture goes by line 154 to a carbon dioxide separator 155 which removes the carbon dioxide from the mixture. A preferred separator is an absorption and stripping unit in which the carbon dioxide is absorbed in an aqueous carbonate solution. Because carbon dioxide is the only acidic gas component then in the mixture, a pure carbon dioxide product is obtained.

Hydrogen containing a small amount of methane is available as a product, this hydrogen is of sufficient purity to be used for such purposes as liquefaction of coal or hydrogenation or organic unsaturates.

The condensed fractions (after suitable re-vaporization) from the cryogenic processing are sent by line 147 to an ethylene plant 148. Here the light oils are first condensed, the acid gases, such as hydrogen sulfide, carbon disulfide and carbon dioxide are removed by washing with such things as potassium carbonate, caustic and aromatic hydrocarbons. The cleaned gas is fractionated to separate ethylene from saturated hydrocarbons, such as ethane, butane, etc. The acid gases are sent by line 149 to a Claus plant 150 which plant also receives acid gas from stripper 129 via line 127 where sulfur may be obtained along with a carbon dioxide containing by-product.

From the ethylene plant, an overhead gas from demethanization containing hydrogen, methane and carbon monoxide is sent by line 151 to a methane reformer 152 where by the addition of water a mixture of hydrogen and carbon oxides is produced. This mixture travels by line 153 to the carbon monoxide shift converter 146 and carbon dioxide separator 155 where it is converted into hydrogen with residual methane and a pure carbon dioxide product.

EXAMPLE

A coal having about 1.9% sulfur is preheated to about 400° F. This coal is mixed with about an equal amount of char and contacted under fluidized bed conditions with a gas containing about 34% hydrogen. The temperature is about 1150° F and the pressure is about 80 psig. After a residence time of about 155 minutes, a char in the amount of 59% by weight of the original coal is obtained which has about 0.64% by weight of sulfur. The fluidizing gas containing about 34 mol percent hydrogen has the same composition as the carbonization and desulfurization gas products except the hydrogen sulfide and condensables have been removed, e.g. 34 mol percent $H_2$; 11.9 mol percent CO; 17.5 mol percent methane; the remainder being ethane, ethylene, carbon dioxide, $C_3$–$C_5$ hydrocarbons, benzene, toluene and xylenes.

A particular advantage of this carbonization and desulfurization is that it may be practiced without catalysts or inorganic sulfide acceptors. While catalysts or sulfide acceptors do provide means by which the rate of carbonization or desulfurization can be increased they also result in a separation and recovery problem to avoid having the ash content of the coke increased and to minimize expense.

This invention has been described in terms of specific processes and compositions, it does also include those variations in chemicals and process steps as would be considered equivalents by one of ordinary skill in the art.

We claim:

1. A method of coal conversion and subsequent product recovery comprising:

(i) a first step of conducting a coal carbonization and desulphurization by contacting a mixture of finely divided particles of char and coal with a gas having at least about 20 mol percent hydrogen and at a temperature of between about 950° to about 1500° F and a pressure of 30–300 psi, said gas containing no more than about 2% by volume of hydrogen sulphide and being substantially free of oxygen, said process yielding a char containing no more than about 1% by weight of sulphur, said char being suitable for the production of a metallurgical grade coking material, and (ii) a second step of recovering individual components including a pure carbon dioxide from the gaseous products of said carbonization and desulphurization step by the use of the gas pressures from said carbonization and desulphurization step which carbon dioxide is recovered by reacting a gas stream containing hydrogen, methane and carbon monoxide with steam and removing carbon dioxide from the reaction products, and wherein this second step includes low temperature condensation of individual components from said gaseous products.

2. The method of claim 1 wherein carbon dioxide is removed from said reaction products by absorption in an aqueous carbonate solution.

3. The method of claim 1 wherein a portion of said gas stream containing hydrogen, methane and carbon monoxide is provided by reacting water with a methane containing gas to yield hydrogen, carbon oxides and unreacted methane.

4. The method of claim 2 wherein said methane containing gas is obtained from de-mathanization of ethylene yielding streams recovered by low temperature condensation in said second step.

5. A method for the conversion of high sulphur coal into a low sulphur char and hydrogen-rich gases and for subsequent product recovery, comprising:

(i) carbonizing and desulphurizing a high sulphur coal by contacting a mixture of finely divided particles of said coal and char with a hydrogen-rich fluidizing gas to provide a fluidized bed of said mixture, said contact being at a temperature of from 950° to about 1500° F and at a pressure of 30–300 psia, said fluidizing gas containing at least about 20 mol percent of hydrogen and no more than about 2% by volume of hydrogen sulphide, said contact being maintained until said coal is converted to a char containing no more than about 1% by weight of sulphur and to hydrogen-rich gas having a volume at least equal to said fluidizing gas, and (ii) recovering individual components from the gaseous products of said carbonization and desulphurization by maintaining the pressure from carbonization and desulphurization upon said gases while subjecting said gases to cryogenic conditions until vapor/liquid equilibrium cause condensation of liquids from said gases, yielding a residual gas stream including hydrogen, methane and carbon monoxide, and wherein hydrogen and pure carbon dioxide are recovered by reacting said residual gas stream with steam and removing carbon dioxide from the reaction products.

6. A method for the conversion of high ash and high sulphur coal into a low sulphur char and hydrogen-rich gases, and for subsequent product recovery, comprising:

I. (a) carbonizing and desulphurizing a high ash and high sulfur coal by contacting a mixture of finely divided particles of said coal and char with a hydrogen-rich fluidizing gas to provide a fluidized bed of said mixture, said contact being at a temperature of from 950° to about 1500° F and at a pressure of 30–300 psia, said fluidizing gas containing at least about 20 mol percent of hydrogen and no more than about 2% by volume of hydrogen sulphide and being substantially free of oxygen, said contact being maintained until said coal is converted to a char containing no more than about 1% by weight of sulphur and to hydrogen-rich gas having a volume at least equal to said fluidizing gas, (b) removing hydrogen sulphide from said hydrogen-rich gas and recycling a portion to the carbonizing and desulphurizing of I(a) as fluidization gases therein, and II. recovering individual components from the remaining portions of said gas by maintaining the pressure from carbonization and desulphurization upon said gases while subjecting said gases to cryogenic conditions until vapor/liquid equilibrium cause condensation of liquids from said gases, the condensation yielding a residual gas stream including hydrogen, methane and carbon monoxide, and III. recovering the separated components, and wherein hydrogen and pure carbon dioxide are recovered by reacting said residual gas stream with steam and removing carbon dioxide from the reaction products.

* * * * *